US009850675B2

(12) United States Patent
Leary et al.

(10) Patent No.: US 9,850,675 B2
(45) **Date of Patent: *Dec. 26, 2017**

(54) POST MOUNT ADAPTER

(71) Applicant: Vinylast, Inc., Lakewood, NJ (US)

(72) Inventors: Steven J. Leary, Barnegat, NJ (US); Benjamin Yin, Hong Kong (HK); Zhang Qi, Guangzhou (CN)

( * ) Notice: Subject to any disclaimer, the term of this patent is extended or adjusted under 35 U.S.C. 154(b) by 0 days.

This patent is subject to a terminal disclaimer.

(21) Appl. No.: 15/359,748

(22) Filed: Nov. 23, 2016

(65) Prior Publication Data

US 2017/0073992 A1 Mar. 16, 2017

Related U.S. Application Data

(63) Continuation of application No. 14/697,152, filed on Apr. 27, 2015, now Pat. No. 9,534,414.

(51) Int. Cl.
*E04H 12/22* (2006.01)
*E04F 11/18* (2006.01)

(52) U.S. Cl.
CPC ..... *E04H 12/2253* (2013.01); *E04F 11/1812* (2013.01); *E04H 12/2238* (2013.01); *E04H 12/2269* (2013.01); *E04H 12/2292* (2013.01)

(58) Field of Classification Search
CPC . E04H 12/22; E04H 12/2253; E04H 12/2276; E04H 12/2292; E04H 17/22; E04H 17/24; E04H 17/261; E04H 17/263; Y10T 403/4602; Y10T 403/7018; Y10T 403/7021; Y10T 403/7022
See application file for complete search history.

(56) References Cited

U.S. PATENT DOCUMENTS

| | | | | |
|---|---|---|---|---|
| 2,168,911 | A * | 8/1939 | Meyer | A47F 5/005 217/69 |
| 4,024,691 | A * | 5/1977 | Hansen | E06B 3/9645 403/402 |
| 4,958,807 | A | 9/1990 | Wylie | |
| 5,274,981 | A * | 1/1994 | Commins | E04B 1/2608 403/232.1 |
| 5,399,044 | A * | 3/1995 | Gilb | E04B 1/26 403/170 |
| 5,901,525 | A | 5/1999 | Doeringer | |
| 6,962,262 | B2 * | 11/2005 | Toma | F16B 12/50 211/182 |
| 7,155,762 | B2 | 1/2007 | Harrow | |
| 7,546,720 | B2 | 6/2009 | Leary | |
| 8,720,839 | B2 | 5/2014 | Lijesnic | |
| 2006/0022188 | A1 | 2/2006 | Collins | |
| 2006/0022189 | A1 | 2/2006 | Collins | |
| 2008/0272353 | A1 | 11/2008 | Fattori | |
| 2011/0186796 | A1 | 8/2011 | Platt | |

OTHER PUBLICATIONS

Atlas Series Quick-Mount Systems, Dec. 16, 2013, pp. 1-2.

* cited by examiner

*Primary Examiner* — Jonathan Masinick

(57) ABSTRACT

In one embodiment, an adapter for increasing exterior dimensions of a post mount support block includes a base having two sides that meet to form an angle of approximately ninety degrees, two legs, wherein each of the two legs extends from an outside edge of a different one of the two sides of the base, and two flanges, wherein each of the two flanges extends from an inside edge of a different one of the two sides of the base, such that each of the two flanges is positioned in a substantially parallel orientation relative to one of the two legs.

18 Claims, 5 Drawing Sheets

POST MOUNT ADAPTER

FIELD OF THE DISCLOSURE

The present disclosure relates generally to railing systems and relates more specifically to support hardware for use in railing installations.

BACKGROUND OF THE DISCLOSURE

Post mounts are frequently used in the construction of decks, porches, stairs, and other structures that include railings. FIG. 1, for example, is a schematic illustration of a portion of an exemplary railing system 100, including a post mount 108. The railing system 100 comprises a railing 102, a support surface 104, and a plurality of posts $\mathbf{106}_1$-$\mathbf{106}_n$ (collectively referred to as "posts 106"). Generally, the rail 102 is supported in a spaced-apart relation relative to the support surface 104 by the posts 106.

In order to mount the posts 106 to the support surface 104 in a substantially invisible manner (i.e., little or no outwardly visible hardware), post mounts may be first installed in the support surface 104. For example, the post $\mathbf{106}_1$ is mounted to the support surface via a post mount 108 (illustrated in phantom). The post mount 108 may include a support pipe 110 supported between two support blocks $\mathbf{112}_1$ and $\mathbf{112}_2$ (collectively referred to as "support blocks 112"), for example as described in U.S. Pat. No. 7,546,720. The post mount 108 is fastened to the support surface 104 in a secure manner, and the hollow post $\mathbf{106}_1$ is then slipped over the post mount 108. In this manner, the post $\mathbf{106}_1$ is supported securely by the support surface 104 and in turn provides secure support for the railing 102.

In some applications, the interior dimensions of the post $\mathbf{106}_1$ may exceed the exterior dimensions of the post mount 108 (e.g., the exterior dimensions of the support blocks 112). In such a case, the post $\mathbf{106}_1$ will not fit over the post mount 108 snugly; it will be loose, and may undermine the stability of the railing system 100.

SUMMARY OF THE DISCLOSURE

In one embodiment, an adapter for increasing exterior dimensions of a post mount support block includes a base having two sides that meet to form an angle of approximately ninety degrees, two legs, wherein each of the two legs extends from an outside edge of a different one of the two sides of the base, and two flanges, wherein each of the two flanges extends from an inside edge of a different one of the two sides of the base, such that each of the two flanges is positioned in a substantially parallel orientation relative to one of the two legs.

In another embodiment, an adapter for increasing exterior dimensions of a post mount support block includes a base having two sides that meet to form an angle of approximately ninety degrees, and two legs, wherein each of the two legs extends from an outside edge of a different one of the two sides of the base in a manner that avoids contact with the other of the two legs.

In one embodiment, a method for installing a post includes installing an adapter on each of two opposing corners of a support block of the post mount, wherein the adapter includes a base having two sides that meet to form an angle of approximately ninety degrees, two legs, wherein each of the two legs extends from an outside edge of a different one of the two sides of the base, and two flanges, wherein each of the two flanges extends from an inside edge of a different one of the two sides of the base, such that each of the two flanges is positioned in a substantially parallel orientation relative to one of the two legs, and subsequent to the installing, slipping the post over the post mount.

BRIEF DESCRIPTION OF THE DRAWINGS

The teachings of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the present disclosure provides a post mount adapter that can be fastened securely to a support block to increase its exterior dimensions and allow for the support of larger posts.

As discussed above, in some applications, the interior dimensions of the post may exceed the exterior dimensions of the post mount (e.g., the exterior dimensions of the support blocks). The exterior dimensions of a post mount support block can be increased by slipping an adapter over the support block, like a sleeve. Conventional adapters tend to be formed as unitary items having hollow, substantially square-shaped cross sections. Embodiments of the present disclosure, by contrast, provide a two-piece adapter that allows the exterior dimensions of a post mount support block to be increased while minimizing the material usage, storage space, and shipping costs associated with the adapter. The post mount adapter of the present disclosure may be used, for example, in conjunction with a post mount that includes support blocks similar to the support blocks disclosed in U.S. Pat. No. 7,546,720, which is herein incorporated by reference in its entirety.

Figure 1:
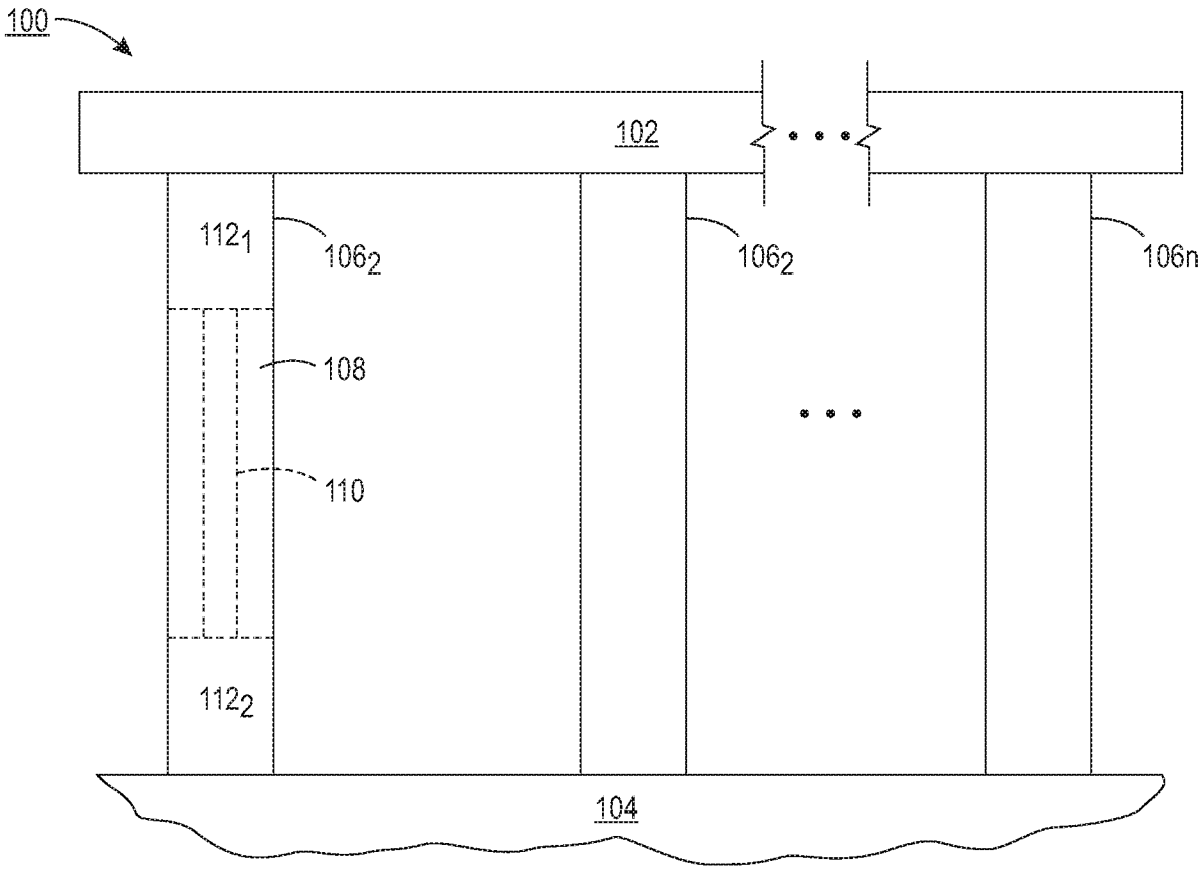
FIG. 1 PRIOR ART
FIG. 1 is a schematic illustration of a portion of an exemplary railing system, including a post mount.
Figure 2A:
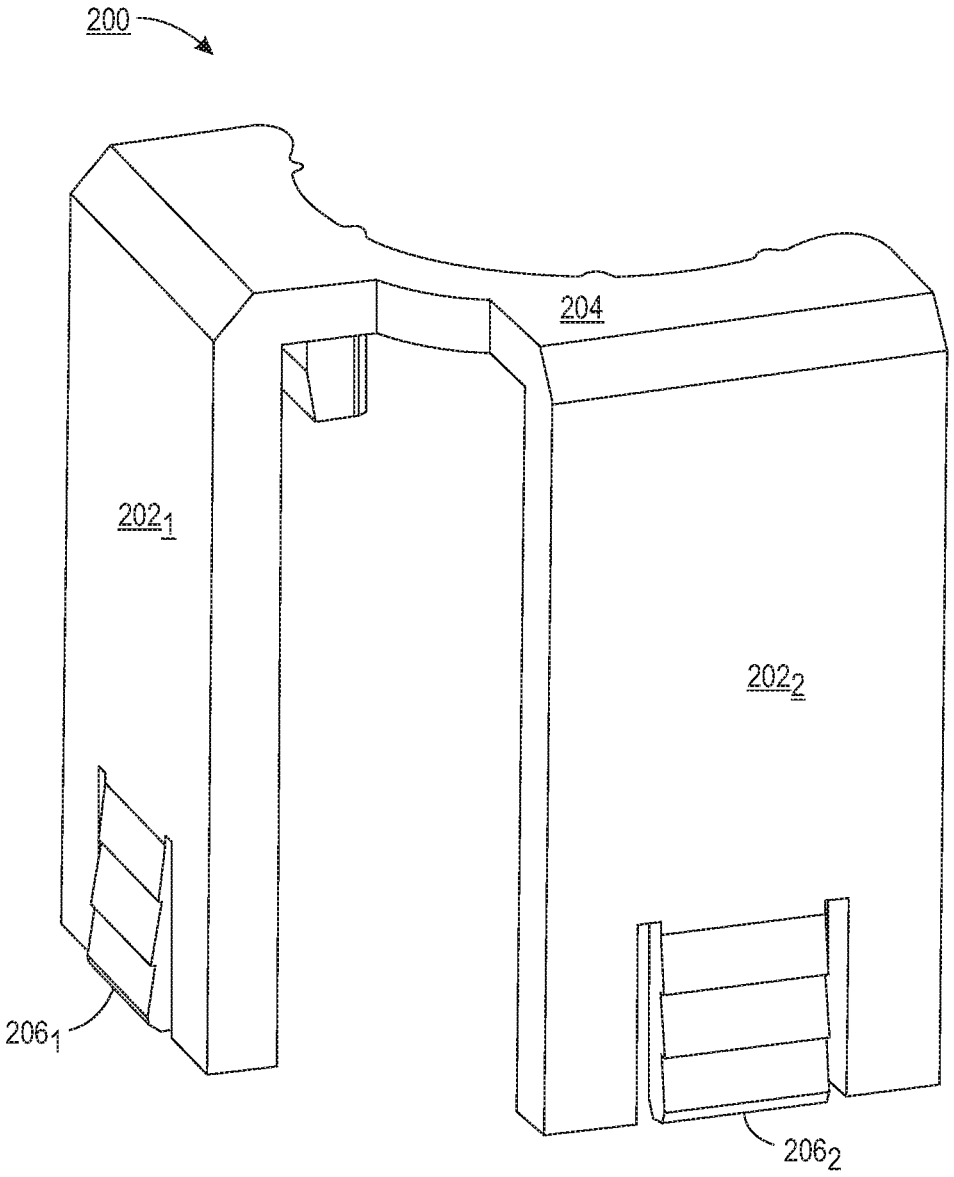
FIG. 2A is an isometric view of the exterior of one embodiment of a post mount adapter, according to the present disclosure.
Figure 2B:
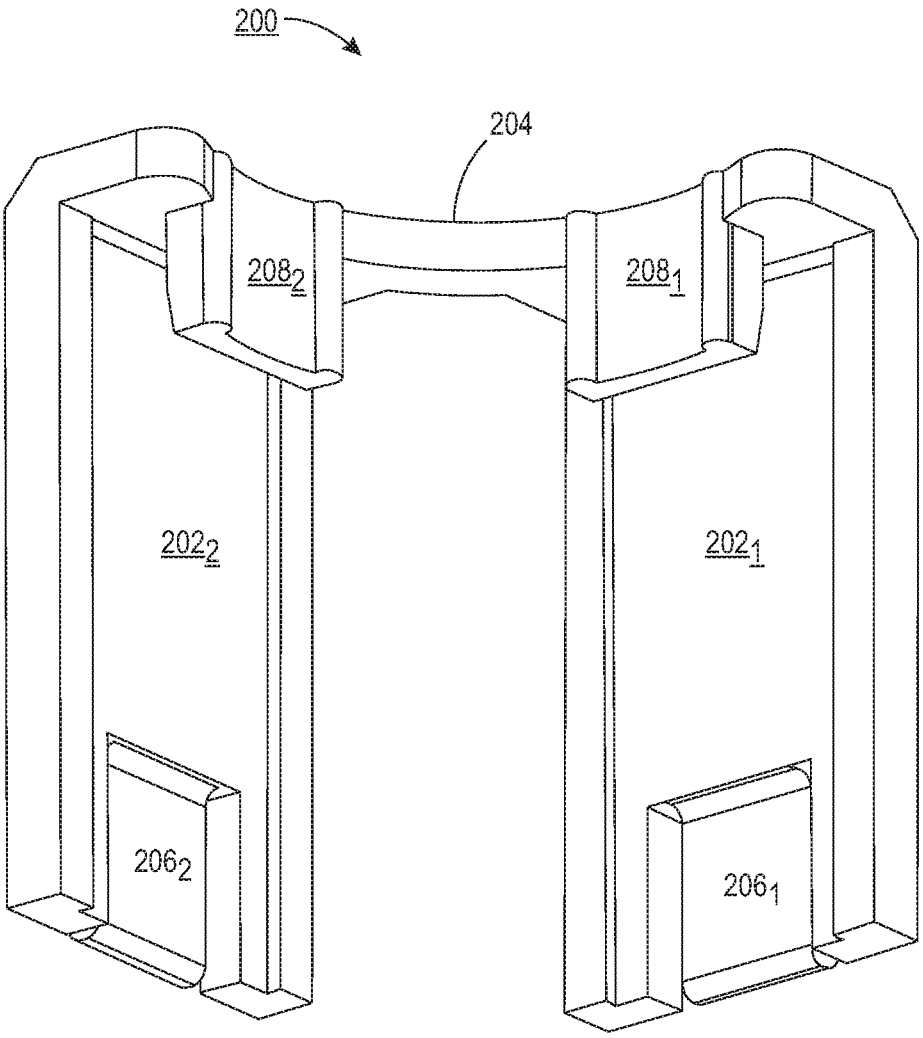
FIG. 2B is an isometric view of the interior of the post mount adapter of FIG. 2A.

FIG. 2A is an isometric view of the exterior of one embodiment of a post mount adapter 200, according to the present disclosure. FIG. 2B is an isometric view of the interior of the post mount adapter 200 of FIG. 2A. Collectively, FIGS. 2A and 2B may be viewed to enhance understanding of the present disclosure.

The post mount adapter 200 comprises a sleeve that is designed to slip over a corner of a post mount support block, in order to increase the exterior dimensions of the support block. As illustrated, the post mount adapter 200 generally comprises a base 204 from which two legs $\mathbf{202}_1$ and $\mathbf{202}_2$ (hereinafter collectively referred to as "legs 202") extend. In one embodiment, the base 204 is substantially L-shaped (e.g., has two sides that meet to form an angle of approximately ninety degrees), with the corner of the "L" (i.e., the point where the two sides of the "L" meet) cut out to accommodate the corner of the support block, as discussed in greater detail below.

In one embodiment, each leg 202 comprises a planar, substantially rectangular appendage that extends away from the base 204. In one embodiment, the legs 202 are coupled to the outside edge of the "L," and one leg 202 is coupled to each side or segment of the "L"; thus, the legs 202 are positioned in a substantially perpendicular orientation (i.e., approximately ninety degrees, within a tolerance of a few degrees) relative to each other. Both legs 202 extend away from the base 204 in the same direction. In one embodiment, the legs 202 do not contact each other.

In a further embodiment, each leg 202 additionally comprises a pressure fin $\mathbf{206}_1$ or $\mathbf{206}_2$ (hereinafter collectively referred to as "pressure fins 206"). The pressure fins 206 comprise tabs formed in the planar surfaces of the legs 202. The tabs are designed to flex when a certain amount of pressure is applied to them. In one embodiment, the tabs may include ribs or ridges.

In addition, two flanges $\mathbf{208}_1$ and $\mathbf{208}_2$ (hereinafter collectively referred to as "flanges 208") extend from the base 204. In one embodiment, the flanges 208 are coupled to the inside edge of the "L," and one flange 208 is coupled to each side or segment of the "L"; thus, each flange 208 is positioned in an orientation that is substantially parallel (i.e., parallel, within a tolerance of a few degrees) to one of the legs 202. In one embodiment, the flanges 208 are shorter than the legs 202, extending only a fraction of the distance from the base 204 that the legs 202 extend. In one embodiment, the flanges 208 do not contact each other.

In one embodiment, the post mount adapter 200 may be formed from the same material as the support block. Thus, the post mount adapter 200 may be formed at least in part from a rigid polymer or composite, such as polypropylene, polyethylene, or the like. The post mount adapter 200 may be fabricated in a variety of sizes, each different size being capable of increasing the outer dimensions of a support block by a different amount.

Figure 3:
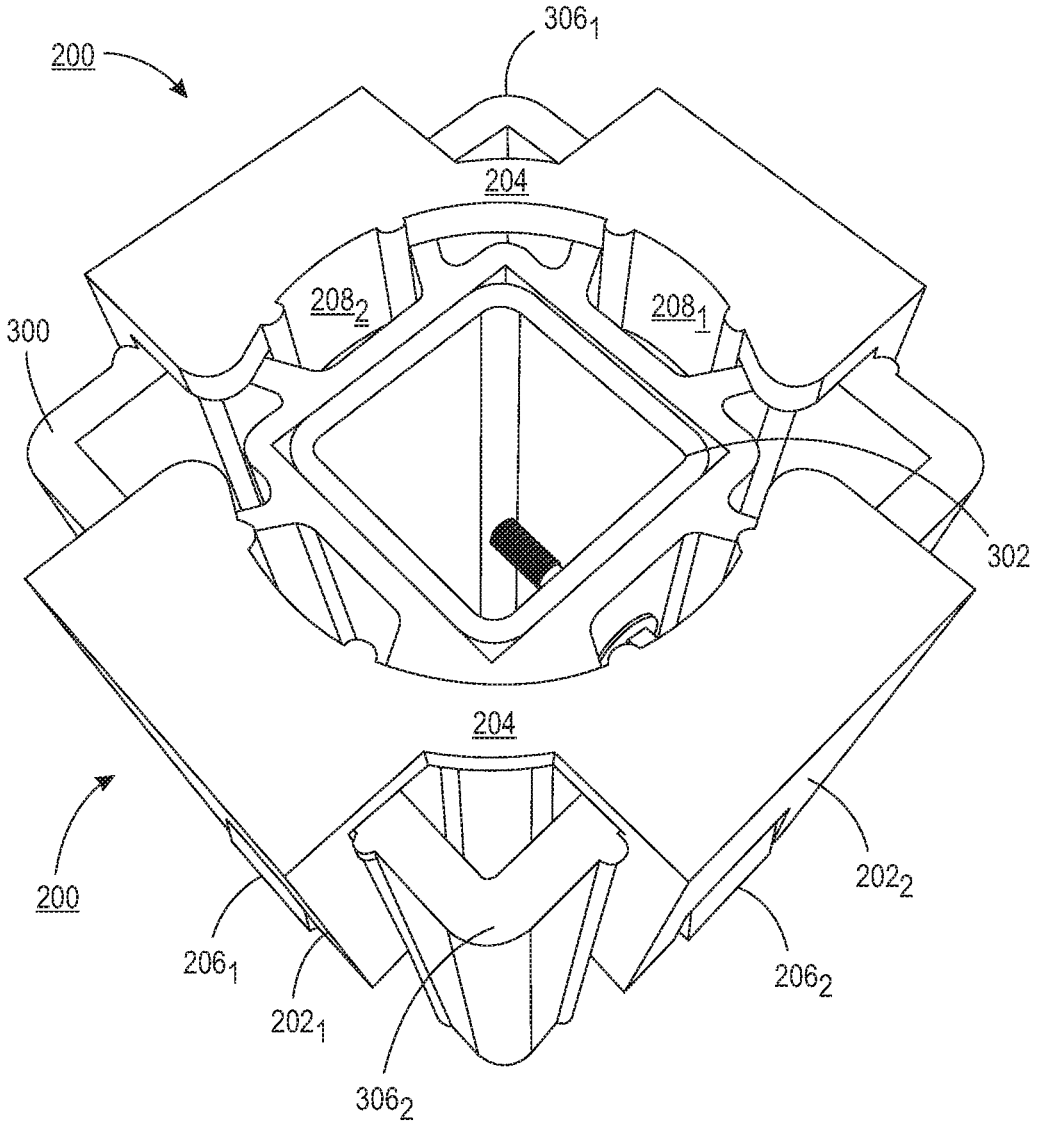
FIG. 3 is a top view illustrating one embodiment of the post mount adapter of FIGS. 2A and 2B, as installed.

FIG. 3 is a top view illustrating one embodiment of the post mount adapter 200 of FIGS. 2A and 2B, as installed. In particular, FIG. 3 illustrates two post mount adapters 200 fitted onto a single support block 300. The support block 300 is mounted at one end of a support pipe 202. In one embodiment, the support block 300 is configured in a manner similar to similar to the support blocks disclosed in U.S. Pat. No. 7,546,720. As illustrated, installation of the post mount adapters 200 on the support block 300 increases the outer dimensions of the support block 300, such that the support block 300 is capable of snugly supporting a post having larger interior dimensions.

As illustrated, the post mount adapters 200 are fitted onto opposing (i.e., diagonal) corners $\mathbf{306}_1$ and $\mathbf{306}_2$ of the support block 300. A post may subsequently be slipped over the post mount, as described above. In this way, two post mount adapters 200 that are, individually and collectively, smaller than a conventional post mount adapter may be used to increase the exterior dimensions of a post mount support block 300. Thus, the same increase in dimensions can be achieved with less material. This reduces manufacturing costs by reducing the amount of material used. It also reduces storage and transportation costs, because the post mount adapters 200 of the present disclosure are smaller than conventional post mount adapters. In additional, unlike conventional post mount adapters, whose hollow interiors consume space that may not be able to be dedicated to other items, the post mount adapters 200 of the present disclosure have a configuration that allows the post mount adapters 200 to be stacked. Thus, more post mount adapters 200 of the present disclosure can fit in the same amount of space that is consumed by fewer conventional post mount adapters.

Figure 4:
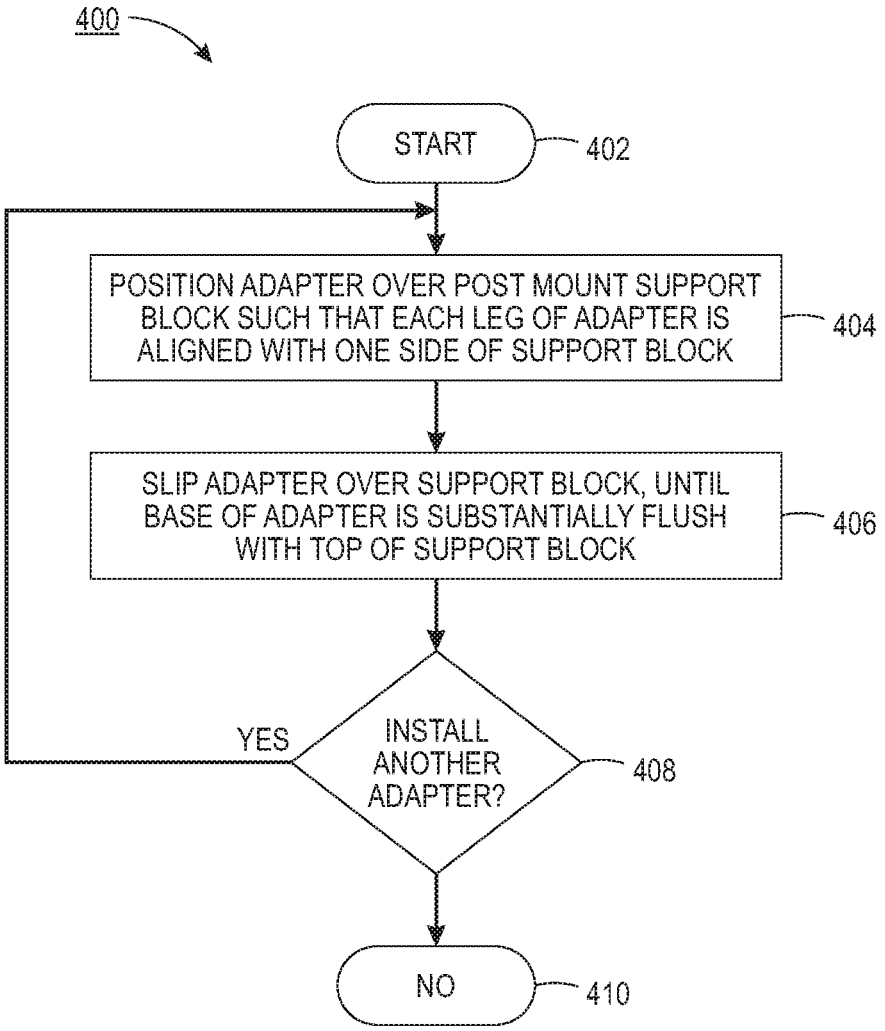
FIG. 4 is a flow chart illustrating one embodiment of a method for installing a post mount adapter onto a post mount.

FIG. 4 is a flow chart illustrating one embodiment of a method 400 for installing a post mount adapter onto a post mount. In one embodiment, the method 400 is performed using a post mount adapter and a support block similar to the post mount adapter 200 and the support block 300 illustrated in the previous figures. As such, reference is made in the discussion of the method 400 to various elements of the previous figures. It will be appreciated, however, that the method 400 may be performed with post mount adapters having configurations that are not necessarily identical to the configuration of the post mount 200 and with support blocks having configurations that are not necessarily identical to the configuration of the support block 300.

The method 400 begins in step 402. In step 404, a single post mount adapter 200 is positioned above a support block 300 of the post mount, such that each leg 202 of the post mount adapter 200 is aligned with one side of the support block 300. The corner at which the two sides of the support block 300 meet will be aligned with the cutout in the L-shaped base 204 of the post mount adapter.

In step 406, the post mount adapter 200 is slipped over the support block 300, until the base 204 of the post mount adapter 200 is substantially flush with the top of the support block 300. When the post mount adapter 200 is slipped onto the support block 300 in this way, the legs 202 of the post mount adapter will be flush with the exterior surfaces of the two sides of the support block 300, as illustrated in FIG. 3. Depending on the dimensions of the support block 300, this arrangement may cause the pressure fins 206 on the legs 202 to flex outward to accommodate the support block 300. In addition, the flanges 208 of the post mount adapter 200 slide into recesses in the support block 300, so that the support block 300 is gripped firmly between the legs 202 and the flanges 208 of the post mount adapter 200, as illustrated in FIG. 3.

In step 408, it is determined whether another post mount adapter 200 should be installed on the post mount. For instance, as discussed above, a support block 300 of the post mount may require two post mount adapters 200 in order to increase the outer dimensions of the support block 300 in an even and symmetrical manner. Additionally, if the post mount includes two support blocks 300, then each of the support blocks 300 may require two post mount adapters 200.

If it is determined in step 408 that no more post mount adapters 200 should be installed, then the method 400 ends in step 410.

Alternatively, if it is determined in step 408 that another post mount adapter 200 should be installed, then the method returns to step 404, and steps 404-406 are repeated until all of the necessary post mount adapters 200 have been installed. Once all necessary post mount adapters 200 have been installed, the method 400 ends in step 410.

The result of the method 400 is a post mount whose support blocks are sized to support a larger post. As discussed above, the post may then be slipped over the post mount, like a sleeve.

Although various embodiments which incorporate the teachings of the present disclosure have been shown and described in detail herein, those skilled in the art can readily devise many other varied embodiments that still incorporate these teachings.

What is claimed is:

1. An adapter for increasing exterior dimensions of a post mount support block, the adapter comprising:

a base;

no more than two legs extending from an outside edge of the base, wherein the no more than two legs are positioned perpendicularly relative to each other, wherein at least one leg of the no more than two legs includes a flexible pressure fin formed in a surface of the at least one leg; and two flanges, wherein each flange of the two flanges extends from an inside edge of the base, such that each flange of the two flanges is positioned in a substantially parallel orientation relative to one leg of the no more than two legs and creates a space between the each flange and the one leg that is sized to grip a portion of the support block, wherein the base is positioned between the no more than two legs and the two flanges, and wherein the base is formed in the shape of an L, with a cutout formed in a corner of the L.

2. The adapter of claim 1 where the cutout is positioned between the no more than two legs.

3. The adapter of claim 1, wherein each leg of the no more than two legs has a planar, rectangular shape.

4. The adapter of claim 1, wherein the no more than two legs are positioned to avoid contact with each other.

5. The adapter of claim 1, wherein the two flanges extend a shorter distance away from the base than the no more than two legs.

6. The adapter of claim 1, wherein the adapter is formed from a rigid polymer or composite.

7. The adapter of claim 6, wherein the rigid polymer or composite is polypropylene.

8. The adapter of claim 6, wherein the rigid polymer or composite is polyethylene.

9. The adapter of claim 1, wherein the two flanges are positioned to avoid contact with each other.

10. A method for installing a post, the method comprising:

securing a support pipe to a support surface;

installing a support block on one end of the support pipe, wherein the support block has a rectangular cross section;

installing a first adapter on a first corner of the support block and a second adapter on a second corner of the support block positioned diagonally from the first corner, wherein each adapter of the first adapter and the second adapter comprises:

a base;

no more than two legs extending from an outside edge of the base, wherein the no more than two legs are positioned perpendicularly relative to each other; and two flanges, wherein each flange of the two flanges extends from an inside edge of the base, such that each flange of the two flanges is positioned in a substantially parallel orientation relative to one leg of the no more than two legs and creates a space between the each flange and the one leg that is sized to grip a portion of the support block, wherein the base is positioned between the no more than two legs and the two flanges, and wherein the base is formed in the shape of an L, with a cutout formed in a corner of the L; and slipping the post over the support pipe, the support block, the first adapter, and the second adapter.

11. An adapter for increasing exterior dimensions of a post mount support block, the adapter comprising:

a base;

no more than two legs extending from an outside edge of the base, wherein the no more than two legs are positioned perpendicularly relative to each other, wherein at least one leg of the no more than two legs includes a flexible pressure fin formed in a surface of the at least one leg; and two flanges, wherein each flange of the two flanges extends from an inside edge of the base, such that each flange of the two flanges is positioned in a substantially parallel orientation relative to one leg of the no more than two legs and creates a space between the each flange and the one leg that is sized to grip a portion of the support block, wherein the two flanges are positioned to avoid contact with each other.

12. The adapter of claim 11, further comprising:

a cutout positioned between the no more than two legs.

13. The adapter of claim 11, wherein each leg of the no more than two legs has a planar, rectangular shape.

14. The adapter of claim 11, wherein the no more than two legs are positioned to avoid contact with each other.

15. The adapter of claim 11, wherein the two flanges have lengths that are shorter than lengths of the no more than two legs.

16. The adapter of claim 11, wherein the adapter is formed from a rigid polymer or composite.

17. The adapter of claim 16, wherein the rigid polymer or composite is polypropylene.

18. The adapter of claim 16, wherein the rigid polymer or composite is polyethylene.

* * * * *